United States Patent [19]

Tovenrath et al.

[11] Patent Number: 4,545,099

[45] Date of Patent: Oct. 8, 1985

[54] DEVICE FOR INDIVIDUALLY SEPARATING AND READYING WARP THREADS FOR THREADING INTO HEDDLES AND DROP WIRES

[75] Inventors: Claus Tovenrath; Frank Tovenrath, both of Lindau, Fed. Rep. of Germany

[73] Assignee: Lindauer Dornier Gesellschaft mbH, Lindau, Fed. Rep. of Germany

[21] Appl. No.: 630,353

[22] Filed: Jul. 13, 1984

Related U.S. Application Data

[63] Continuation-in-part of Ser. No. 430,282, Sep. 30, 1982, abandoned.

[30] Foreign Application Priority Data

Mar. 25, 1982 [DE] Fed. Rep. of Germany ..... 3210920

[51] Int. Cl.[4] ..... D03J 1/14

[52] U.S. Cl. ..... 28/202; 28/203

[58] Field of Search ..... 28/202, 203, 206

[56] References Cited

U.S. PATENT DOCUMENTS 1,147,413 7/1915 Lea ..... 28/202
1,282,059 10/1918 Field ..... 28/202
1,317,024 9/1919 Chance et al. ..... 28/202
1,383,195 6/1921 Field et al. ..... 28/202
2,696,654 12/1954 Townsend ..... 28/203

FOREIGN PATENT DOCUMENTS 46-23586 7/1971 Japan ..... 28/202

*Primary Examiner*—Robert R. Mackey
*Attorney, Agent, or Firm*—W. G. Fasse; D. H. Kane, Jr.

[57] ABSTRACT

The warp threads presented from a curtain of threads are slightly spread apart and tensioned by a constantly rotating tensioning shaft with an enlarged part. A sleeve with a screw-like guidance groove is slipped over the last part of the tensioning shaft, this sleeve being switched as needed by means of a coupling to be driven in synchronization with the tensioning shaft or to be shut off in a specific angular position. The sleeve is provided at its beginning with a knife-like guide beak which during rotation separates the outermost warp thread from the curtain of threads and deposits it into the guidance groove. The spacing between the turns of the groove corresponds to the spacing between the draw-in needles. When the sleeve is stopped, the separated warp threads individually deposited into the turns of the groove are arranged in the proper transfer position to the draw-in needles.

11 Claims, 10 Drawing Figures

DEVICE FOR INDIVIDUALLY SEPARATING AND READYING WARP THREADS FOR THREADING INTO HEDDLES AND DROP WIRES

This is a continuation-in-part of application Ser. No. 430,282, filed 9/30/82, abandoned.

FIELD OF THE INVENTION

The invention relates to a device for individually separating and readying warp threads wound on a warp beam and presented in the form of a curtain of threads for threading the warp threads into heddles and drop wires using a warp thread draw-in apparatus equipped with draw-in needles.

DESCRIPTION OF THE PRIOR ART

The warp threads wound on the warp beam must be individually threaded through the heddle eyes of each heddle in preparation for the weaving process, and further they must be drawn through the apertures of drop wires. As a rule this is done outside the weaving machine proper. For threading the threads into the heddles and drop wires, use is made of known automatic draw-in apparatuses of which the draw-in needles are guided through the eyes of the heddles and drop wires and which take up the warp thread to be pulled in and then are drawn back in the opposite direction again through the heddles and drop wires, the thread gripped by the draw-in needle being pulled through the heddle and the drop wire. However, before the warp thread can be gripped by the draw-in needle, each warp thread must be individually separated from the layer of threads wherein the warp threads are arranged one against the other. Each warp thread must be moved into a pre-positioning station where the respective thread separated from the layer is kept ready for transfer to the draw-in needle.

In a device for feeding warp threads which is not described in a publication, a warp thread is separated from the layer by a separating needle and several components holding and guiding a portion of the layer of threads, whereupon this thread is transferred to a transfer hook which moves it into a stationary thread clamp in a transfer station. However only one thread at a time can ever be presented or readied by the thread clamp and accordingly it is possible to operate with only a single draw-in needle. The operational reliability of this device is rather unsatisfactory and, most significantly, the operational rates are low.

German Pat. No. 2,847,520 discloses a thread presenting device for the simultaneous presentation, i.e., readying of several warp threads arranged at mutual equal spacings. In this device, a substantial number of equidistant first thread clamps arranged next to one another are provided on an endless chain of which one end extends parallel to a guide rail from a transfer station for the thread to a feeding station. Each first thread clamp is associated with a thread holder arranged at a given spacing away as viewed in the direction of the warp thread and also arranged at the chain on the side of a second thread clamp between the transfer hook and the first thread clamp. The second thread clamp comprises two clamping members parallel to the plane formed by the warp threads and to one of the chain ends. The clamping members extend from the transfer station to the feeding station.

In this known thread feeding device, the individual threads separated from the remaining warp threads are transferred from the transfer hook to each of the thread clamps provided on the chain. Due to the motion of the chain, the thread clamp holding one thread is also displaced from the transfer station toward the feed station, while simultaneously the next thread clamp is being readied to receive the next warp thread. After this procedure has been repeated several times, there will be several thread clamps holding threads at the transfer station. The thread holders associated with the thread clamps and the common second thread clamp assure that these threads are kept tensioned in the region between the first thread clamp and the thread holders. Simultaneously, the individual warp threads are kept at the desired mutual spacing corresponding to the spacing between the thread clamps. Several draw-in needles can be inserted simultaneously between the threads so readied, and these needles then will simultaneously take care of the readied warp threads during the retraction phase.

During the time the threads are made to pass through the heddles and drop wires by the draw-in apparatus, the thread feed system can be running independently of the operational rate of the draw-in apparatus and can meantime separate another number of threads from the curtain of threads and ready them at the feed station. The revolving chain with the substantial number of thread clamps (for instance up to 80 thread clamps) mounted thereto acts like a supply magazine being filled with threads while the draw-in apparatus carries out its operational stroke.

While the operational performance of this device is substantially higher than that of the initially cited system, it requires a complex mechanical construction to implement the individual processes. The revolving chain alone with its many opening and closing thread clamps is costly. Moreover, the separation of the individual threads requires a large number of precise and cooperating parts. The warp threads arriving from the warp beam, as already mentioned, are presented as a layer or a curtain of threads and even may be precombed. The warp threads are individually and consecutively separated from the curtain of threads and inserted into the thread clamp. A separating needle is provided for that purpose which will come sideways to a gentle rest against the outermost thread of the curtain. Furthermore, the separating needle is moved from behind against the curtain of threads. The separating needle is provided at its fore end with a fine offset of which the width always corresponds to the diameter of the thread to be separated from the curtain. The thread which is seized by this offset in the advance of the needle and which is separated is pressed against a double guidance bail and is additionally kept tensioned by a movable push member in order that the separated thread be moved into a defined position where it will be gripped by a transfer hook and from whence it can be inserted in the readied thread clamp of the revolving chain. A special monitoring device is provided to ascertain whether a thread has been separated, seized by the transfer hook and carried along.

The complex and hence trouble prone construction of this thread separation device entails operational difficulties. The separating needle with its small offset does not exclude malfunctions, misses threads, and sometimes even separates several threads at the same time, hence the above mentioned monitoring system is required. Accordingly, a reliable separation and a feed of the warp threads both accurate in time and place for the draw-in procedure will not be assured. This circumstance is especially disadvantageous when the threads must be patterned and the warp threads must be drawn into specific heddle frames in a constantly changing sequence following a rigorous rule.

OBJECTS OF THE INVENTION

It is therefore an object of the present invention to avoid the stated drawbacks in a device of the above type for separating and readying warp threads and to provide a device not requiring any substantial number of mutually coupled trouble prone mechanical parts. It is a further object to use simple, reliably operating parts, which during a high operational performance meet all requirements regarding patterning and the like in a problem-free manner. Also, the dependency on thread thickness and on the special design of a separating needle is eliminated and reliable individual separation is possible, regardless whether the warp threads in the presented curtain of threads are pre-combed or not.

SUMMARY OF THE INVENTION

These objectives have been achieved by the invention in that a rotatable tensioning shaft gradually merging at its end into a cylindrical end part of larger diameter is arranged behind the curtain of threads transversely to the direction of the threads and in that in the last segment of the end part, there is arranged a cylindrical sleeve with screw-like guidance grooves which is rotatable independently of the tensioning shaft and which coaxially surrounds the end part with a stepped increment in its diameter relative to the tensioning shaft.

When the tensioning shaft is rotated, the individual warp threads of the curtain of threads are slightly spread apart by the transition segment which, for example, is conical, and furthermore they will be tensioned and guided to the cylindrical end part. The warp threads are consecutively separated from the curtain of threads at the beginning of the sleeve and individualized in the guidance grooves of the sleeve. The spread threads are gripped in the area of the sleeve by the needles or hooks of the draw-in apparatus and are drawn into the eyes of the heddles or drop wires. Advantageously, the number of the turns of the guidance grooves in the sleeve corresponds to the maximum number of warp threads which can be simultaneously drawn in by the draw-in apparatus.

In order to have the capability of associating specific warp threads with the particular selected heddles or heddle frames for the purpose of patterning, only part of the warp threads which must be drawn-in simultaneously should be presented rather than the totality. To that end, the cylindrical sleeve is driven stepwise each time in full, single revolutions, or continuously. In this manner and only when needed, the outermost of the warp threads spread apart by the conical transition section and guided to the cylindrical end part will be taken up by the sleeve where the desired thread spacing also will be set. This type of control for the sleeve drive can be easily derived from the continuous drive of the tensioning shaft and the end part and can be transmitted by a coupling.

The advantage of the invention is that except for the advanced and then retracted draw-in needles of the draw-in apparatus, there is no complex motion of delicate single members mutually coupled in an articulated manner. The individual separation and spreading of the warp threads presented as a curtain of threads is reliably implemented by the rotating conical and cylindrical segments, and most importantly in a non-stressing manner. The device does not tend to soiling and can be used for all thread thicknesses.

BRIEF DESCRIPTION OF THE DRAWINGS

The invention will be further illustrated by reference to the accompanying drawings, in which.

DETAILED DESCRIPTION OF PREFERRED EXAMPLE EMBODIMENTS AND OF THE BEST MODE OF THE INVENTION

Figure 2:
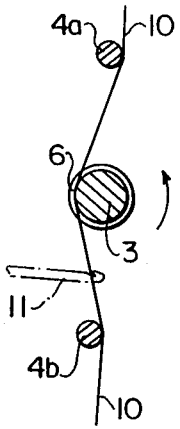
FIG. 2 is a view in cross-section along the line A—A of FIG. 1.
Figure 1:
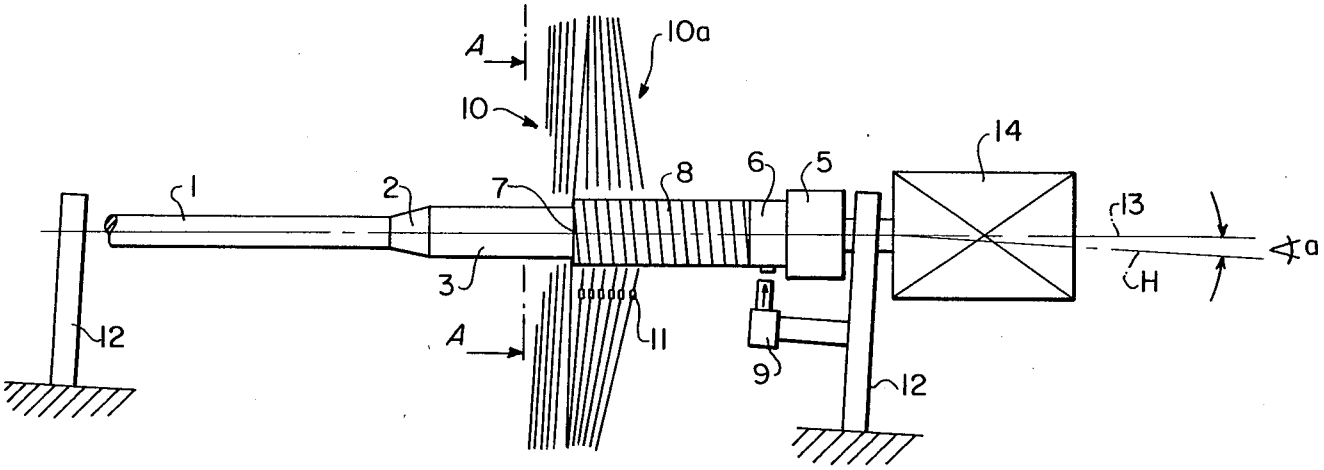
FIG. 1 is a side view of one embodiment of the device.

The entire device will be described with selective reference to FIGS. 1 through 3. The warp threads come from a warp beam (not shown) and arrive in a conventional mutually parallel manner, being held at their ends by a clamping rail (also not shown). As shown by FIG. 2, two tensioning shafts 4*a* and 4*b* are mounted one above the other in the thread path ahead of the clamping rail, and press against the warp threads 10. The arrangement of the warp threads 10 as a curtain of threads is indicated in FIG. 1. Also, a warp thread draw-in apparatus (not shown in further detail) is provided, of which the draw-in needles are advanced toward the curtain of threads and which upon retraction draw the gripped warp threads through the associated and readied heddles or drop wires. As viewed from the side of the draw-in apparatus, the device of the invention for individually separating the warp threads is mounted behind the curtain of threads. This device is shown in a simplified manner in FIG. 1 and as viewed from that side of the curtain of threads which is away from the draw-in apparatus with its needles. This arrangement in the back of the curtain of threads also is indicated in FIG. 2, which shows one draw-in needle 11.

The individual separating device is mounted between the two tensioning shafts 4*a* and 4*b* of FIG. 2 (but omitted from FIG. 1 for the sake of overview). This device comprises a rotatable tensioning shaft 1 supported in the two frame-supported bearings 12 and can be continuously driven by a variable speed motor 14. The axis of rotation of the tensioning shaft 1 is denoted by 13 and the direction of rotation of the tensioning shaft 1, or of its larger part 3, is indicated by an arrow in FIG. 2. The tensioning shaft 1 has a gradual transition into a thicker cylindrical end part 3. The transition part in this case is the conical part 2. At the last segment of the end part 3, a cylindrical sleeve 6 is coaxially slipped over this end part 3 and supported thereon in a rotatable manner. An engaging and disengaging coupling 5, for instance a single-turn coupling, is mounted to the end of the sleeve 6. This coupling 5 makes it possible to allow the sleeve to selectively rotate in synchronization with the tensioning shaft 1 or to keep it in place in a given angular position. The sleeve 6 therefore can be driven stepwise for single or also for several consecutive full revolutions of the tensioning shaft 1. The attendant signal analysis preferably is implemented through contact lugs or by contactless switch elements in a precisely predetermined position of the sleeve 6, as indicated in FIG. 1 by the element 9. The fore end of the sleeve 6 faces the curtain of threads and represents a step-up in diameter with respect to the end part 3. The sleeve end is provided with a special thread guide 7 issuing into a screw-like guidance groove 8. The thread guide 7 is so designed as a knife-edge driving beak that upon rotation of the sleeve 6 this sleeve 6 separates a single warp thread 10 from the curtain of threads and guides it into the guidance groove 8. The pitch of the guidance groove 8 is selected in such a manner that the spacing between the individual groove turns corresponds to the spacing between the individual draw-in needles 11, as shown by FIGS. 1 and 3.

Figure 3:
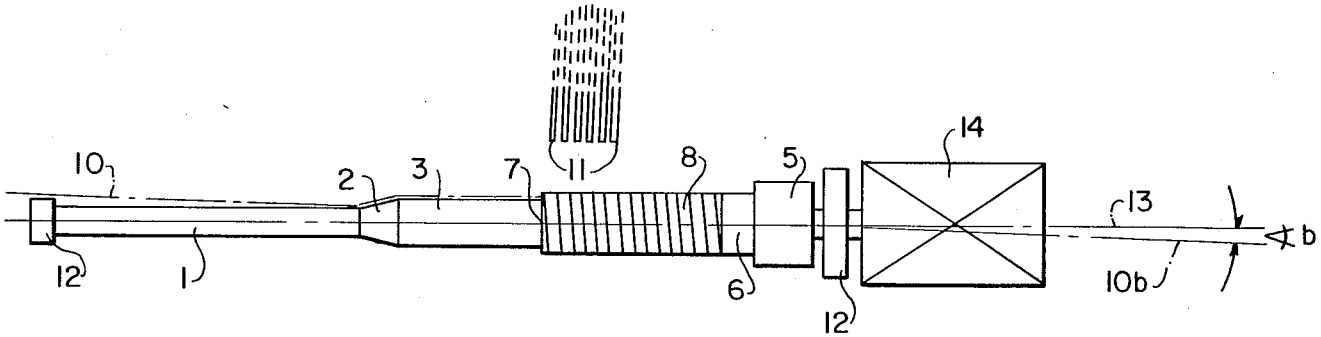
FIG. 3 is a top view of FIG. 1.

FIG. 3 indicates that the axis of rotation 13 of the tensioning shaft 1 is oblique by a slight angle b with respect to the plane 10*b*, indicated in dash-dot lines, of the curtain of threads 10, and that the beginning of the curtain of threads, that is, the foremost warp threads, come to rest against the tensioning shaft 1 approximately in the area of the conical part 2. In operation, that is when the tensioning shaft 1 is rotating, this arrangement will secure the orderly position of the warp threads. Simultaneously, a relative displacement, substantially controlled by the thread take-off during the draw-in procedure, takes place between the warp beam and the device in its longitudinal direction. Thereby, new warp threads from the curtain of threads consecutively slide up the conical part 2, in which course they are deflected from their prior rectilinear motion and are increasingly tensioned. At the same time some mutual spreading of the warp threads is effected and additionally a correction for any warp thread positions still being crossed. This readying operation for the warp threads 10 continues beyond the conical part 2 in the wider cylindrical end part 3. The end part 3 and possibly also the conical part 2 advantageously have a polished surface.

The moment the beginning of the curtain of threads 10 arrives at the beginning of the sleeve 6 on account of the above parallel relative displacement between the warp beam and the device of the invention, the thread guide 7 by means of its drive beak, which is not further detailed in the drawing, in the course of the rotation separates the first warp thread and during each further revolution another warp thread, and deposits it into the guidance groove 8. As a result, further spreading of the separated warp threads 10*a* takes place in such a manner that the threads on the sleeve 6 on account of the pitch of the guidance groove 8 are mutually spaced in a manner corresponding precisely to the spacing between the draw-in needles 11. This characteristic is shown in FIGS. 1 and 3. Due to the rotation of the sleeve 6, the separated warp threads 10*a* migrate along this sleeve 6 while retaining their mutual spacing. Where appropriate, another component not further described may be provided to prevent the threads from slipping out of the guidance groove 8. At a particular angular position of the sleeve 6, the separated warp threads 10*a* will be separated individually and precisely in the path of the draw-in needles 11. This position is clearly shown in both FIGS. 1 and 3. In this position, the coupling 5 is actuated and the sleeve 6 is deactivated. Presently, the draw-in needles 11 can be advanced to grip the particular associated warp threads. This procedure is noted in FIG. 2 by a draw-in needle 11 shown in dash-dot lines. When the needles are retracted, the gripped warp threads together with their ends are pulled out of the above mentioned clamping rail and threaded in known manner into the heddles or drop wires which also were readied and are not shown in the drawing.

As shown by FIG. 1, the axis of the rotation 13 of the tensioning shaft 1 furthermore is advantageously slanted by a slight angle a with respect to the horizontal H, that is, it no longer is at a right angle to the warp threads 10 presented at the curtain of threads, rather it rises slightly with respect to the end part 3. Thereby the separation of the individual threads by the thread guide 7 will be improved.

The screw-like guidance groove 8 of the sleeve 6 comprises at least as many turns as there are draw-in needles 11. When the guidance groove 8 is completely filled it will be possible to feed all the draw-in needles 11, for instance six, simultaneously. The tensioning shaft 1 with its end part 3 rotates continuously during the draw-in procedure and stresses the warp threads 10 however without these warp threads being removed or individually separated. After the termination of the draw-in procedure, the sleeve 6 is again coupled to the tensioning shaft 1 for a number of full revolutions, whereby the guidance groove 8 again receives a number of threads, and these threads are presented individually to the draw-in needles. The sleeve drive is automatically coupled upon termination of the draw-in procedure. The sleeve 6 will be stopped again only after it reaches a given angular position, and when following a specific number of individual full revolutions, the desired number of warp threads 10*a* has been individually separated and readied and can be simultaneously drawn through the needles 11.

The step-wise drive of the sleeve 6 resulting each time in full single revolutions makes it possible, after the separation into individual threads of an arbitrary number of threads up to the maximum number (corresponding to the number of draw-in needles), to shut off the sleeve 6 and therefore to simultaneously draw-in single or several warp threads entirely as a function of the variety of the patterns involved. The control of the coupling 5 for the sleeve 6 can be implemented in a corresponding manner, that is, it might be automatically programmed by the pattern or be initiated when the sleeve is completely filled with warp threads.

Figure 1A:
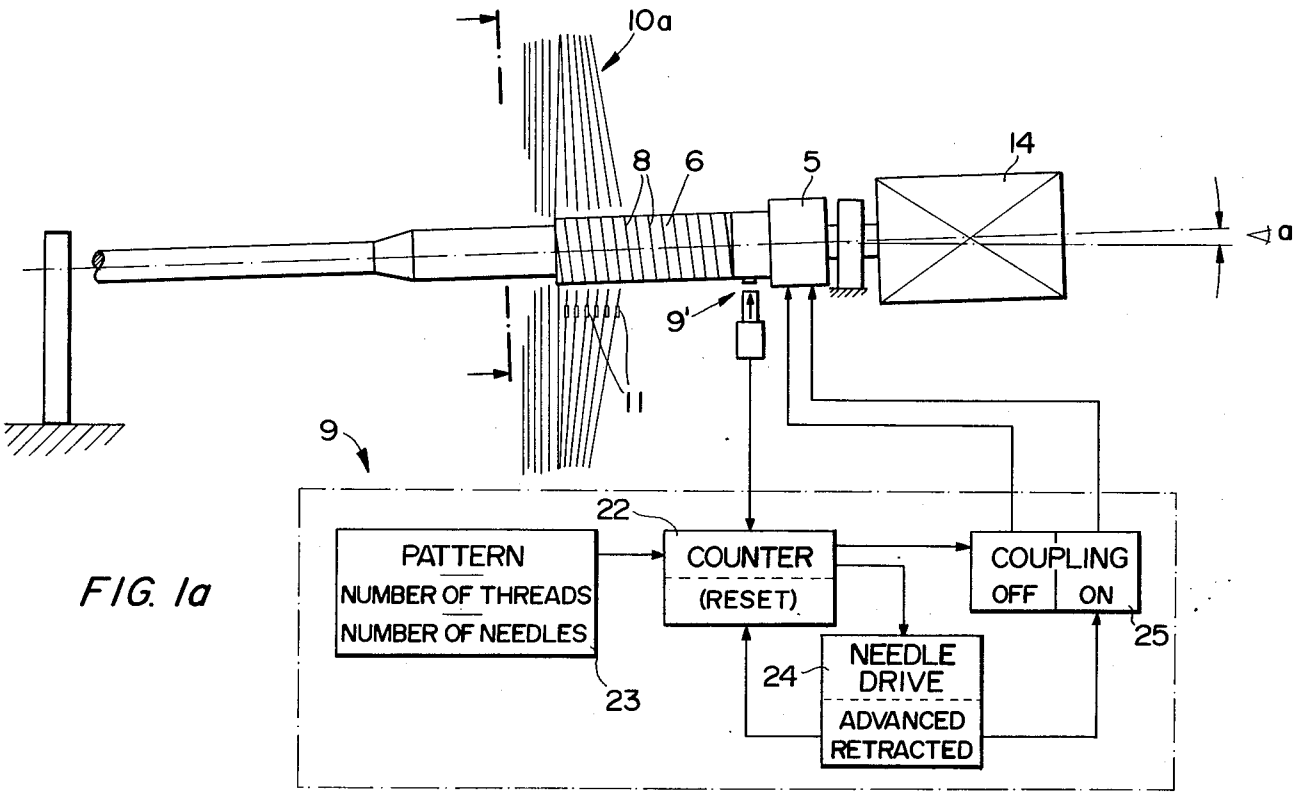
FIG. 1*a* is a variation of FIG. 1 with a diagrammatic control system.

FIG. 1*a* schematically shows the control system cited only tentatively above and which serves to drive the sleeve 6. The apparatus denoted by 9 in FIG. 1 is divided, for the purpose of signal analysis, comprising an element 9' mounted near the sleeve 6 and sensing its revolutions, and a control system 9 denoted as the dash-dot box. The control system 9, in turn, contains several individual members which again are shown in simplified manner because their design is known and they are not an object of the present invention.

The signals picked up upon each full revolution of the sleeve 6 in the element 9' are fed into a counter 22 where they are summed. The predetermined patterning of the warp threads to be drawn in or the number of warp threads which must be simultaneously drawn in or the number of needles to be used in the drawing-in operation are stored in the device 23. In this manner, the number of warp threads 10*a*, which must be readied in the grooves 8 of the sleeve 6 for the next draw-in process, is provided. This number, predetermined by the device 23, is compared in the counter 22 with the number of revolutions of the sleeve 6 picked up by the element 9'. The moment the numbers agree, the counter emits a signal to the control system 25 for the coupling 5, whereby the coupling holds the sleeve 6 in a precisely predetermined angular position. Correspondingly, the counter 22 also feeds a signal to the control system 24 to drive the draw-in needles 11. The needles 11 are advanced empty, in known manner, accept the readied warp threads 10*a*, and then are pulled back together with the warp threads. The moment the draw-in process is completed and the draw-in needles 11 have resumed their retracted position, the control system 24 emits a signal to the coupling control system 25, whereby the coupling 5 is connected again and the sleeve 6 is again made to rotate. Simultaneously, the counter 22 is reset, whereby a new counting process for the next part of the warp thread patterning and a corresponding readying of warp threads for the draw-in position can be initiated.

Figure 1B:
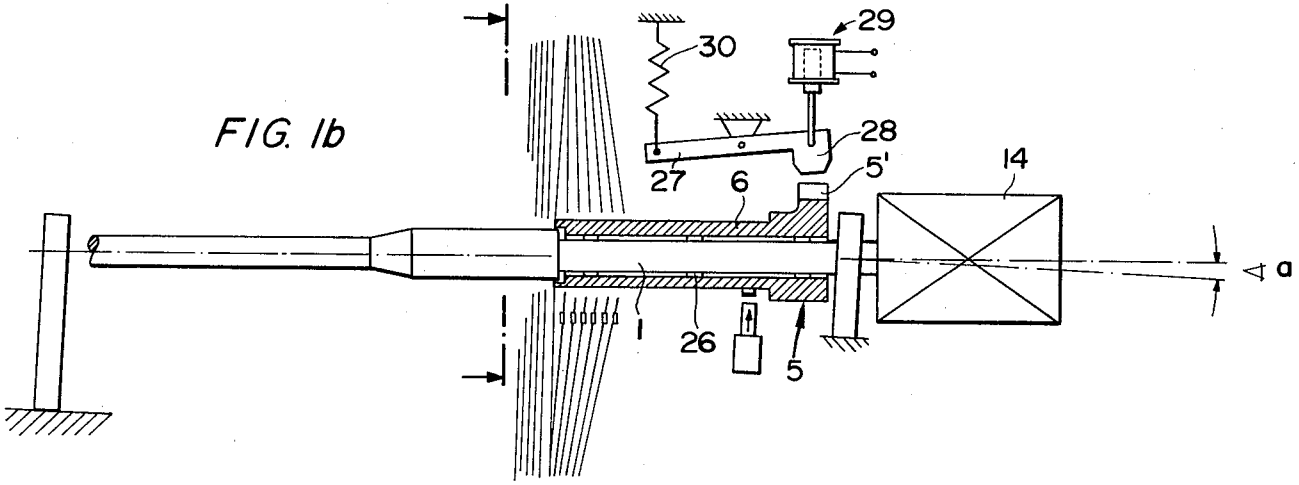
FIG. 1*b* is a variation of FIG. 1 with a diagrammatic coupling system.
Figure 1C:
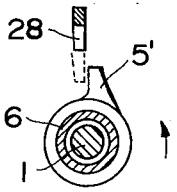
FIG. 1*c* is a cross-section of FIG. 1*b* when seen from the left.

The operation of the coupling 5 in relation to FIGS. 1*b* and 1*c* will now be discussed. The arrangement corresponds to that of FIG. 1 except that the sleeve 6 is shown in longitudinal section. The bearing sites of the sleeve 6 on the tensioning shaft 1 are denoted by 26. FIG. 1*c* shows a cross-section of the tensioning shaft and the sleeve 6 seen from the left. As mentioned, the tensioning shaft 1 is continuously driven by the motor 14. Again the coupling part is denoted generally by 5 and is mounted to the end of the sleeve 6 near the motor. At the same end there is also a projecting beak 5' mounted on the sleeve surface and acting as a stop. Outside the sleeve 6 an electromagnet 29 is provided which, upon excitation, moves a pivotally supported lever 27 against the force of a return spring 30. The lever 27 is provided with a projection 28 at its end, this projection resting against the stop beak 5' of the sleeve 6 or releasing it, depending on the excitation of the electromagnet 29. The two switch positions of the projection 28 are indicated in FIG. 1*c* with solid or dotted lines.

The operation of the arrangement is as follows: Be it assumed that the electromagnet 29 is not energized and that, accordingly, the projection 28 of the lever 27 under the action of the spring 30 is in the dotted position (FIG. 1*c*). The tensioning shaft 1 is continuously driven by the motor 14. Due to the friction at the bearings 26, the sleeve 6 tends to be set into rotation, but this effect is prevented by the stop beak 5' and the projection 28. For a short-term energization of the electromagnet 29, the projection 28 and the stop beak 5' disengage and, due to the friction, the sleeve 6 presently will be rotated together with the tensioning shaft 1. Because the electromagnet 29 is excited only short-term, the projection 28 at once returns into the dotted position and, by means of the stop beak 5', again keeps the sleeve 66 in position after it has rotated one full revolution, and this precisely in the predetermined angular position. If the electromagnet 29 is coupled to the control system 9 discussed in FIG. 1*a*, then the magnet 29 remains energized longer depending on the commands issued by the control system 9 and the sleeve 6, therefore, can carry out several consecutive revolutions before being kept in position again by means of the stop beak 5' and the projection 28 once the counter 22 has ascertained a given number of revolutions. This system, therefore, makes it possible to couple, as needed, the sleeve 6 to the drive motor 14.

In a modified design of the device of the invention, the relatively long tensioning shaft may be shortened, beginning for instance only with the conical or otherwise tapered part 2 and in this instance including only the end part 3 with the sleeve 6. A cantilever bearing might be provided for that purpose.

Figure 4:
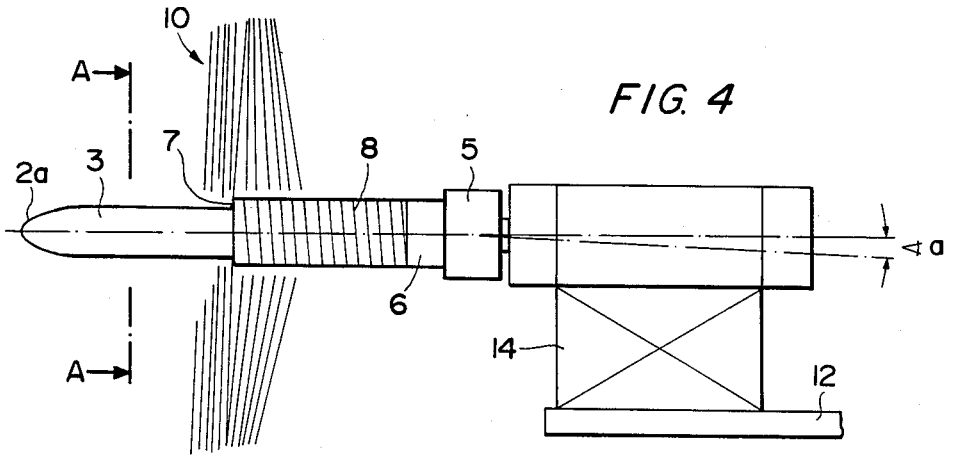
FIG. 4 is a side view of another embodiment of the device.

In the embodiment of FIG. 4, the long tensioning shaft 1 is omitted and the apparatus begins with a rounded tip 2*a*. As already noted above, a cylindrical end part 3 continues the tip 2*a* and rotatably supports the separate sleeve 6 with the guidance groove 8. The diameter again increases stepwise between the cylindrical end part 3 and the sleeve 6 which begins with a thread guide 7.

Figure 4A:
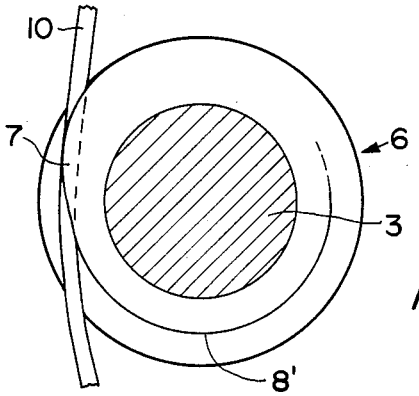
FIG. 4*a* is a sectional view taken on line A—A of FIG. 4.

FIG. 4*a* is a cross-section of FIG. 4 and clearly shows the stepped increase in diameter from the cylindrical end part 3 to the sleeve 6. The guidance groove 8 also is indicated on the circumference of the sleeve 6. The transition from the cylindrical end part 3 to the sleeve 6 is represented by the thread guide 7 at the beginning of the thread. A warp yarn is located in the first threaded groove and has just been seized by the thread guide 7 and separated from the remaining yarns.

Figure 5:
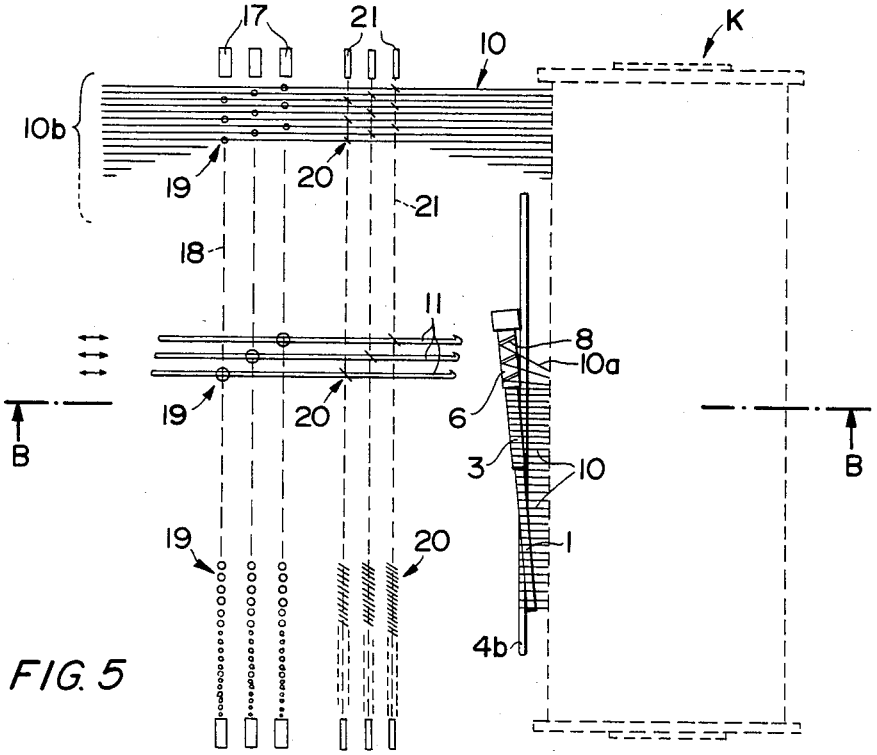
FIG. 5 is a top view of the apparatus of the invention for singling out warp yarns.

FIG. 5 is a top view of the position of the appratus of the invention for singling out warp yarns compared to the remaining components of the overall equipment required during the draw-in process, and is shown in a much simplified form.

Figure 6:
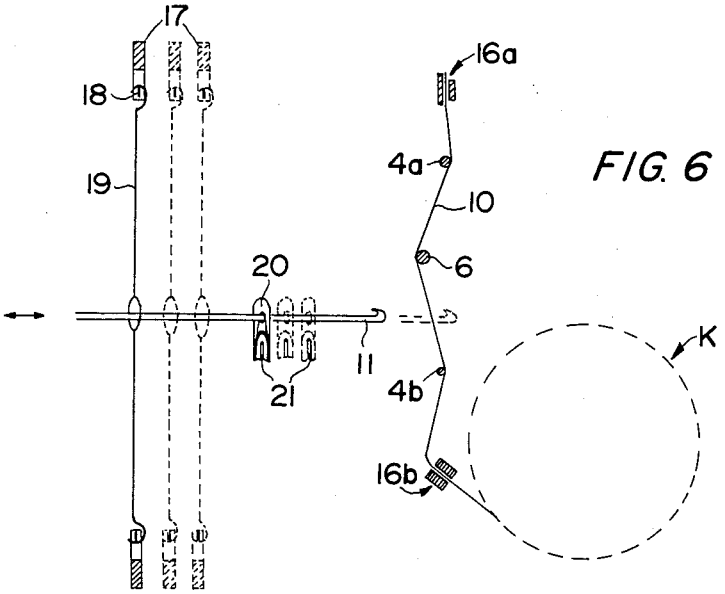
FIG. 6 is a view in cross-section taken along line B—B of FIG. 5.

FIG. 6 is a cross-section of FIG. 5 along the line B—B. A warp beam K is denoted by dashed lines and the warp threads 10 therefrom are tensioned as a thread curtain 10 between two clamping rails 16*a* and 16*b*. Part of the warp threads 10 of this curtain are shown in FIG. 5 underneath the line B—B. The path of these warp threads is indicated only roughly and half of the clamping rails 16*a* and 16*b* are omitted from FIG. 5 for the sake of clarity.

FIG. 5 clearly shows the obliqueness of the tensioning shaft 1 with the cylindrical end part 3 and rotatable sleeve 6 with respect to the curtain of the warp threads 10. The gradually increasing tautness of the individual warp threads and their alignment are clearly shown. Three guidance grooves 8 are coarsely shown on the sleeve 6, each of which contains one warp thread 10*a* separated from the thread curtain 10. Three draw-in needles 11 are mounted in front of the sleeve 6 and correspond to the spacing between the guidance grooves 8 of this embodiment. These needles 11 advance and retract as shown by the double arrows. This arrangement makes it possible to simultaneously draw one to three warp threads into the associated heddles 19 or the drop wires 20. Harnesses 17 are mounted parallel to the axis of the warp beam K. The harnesses 17 each contain heddle support rails 18 in which the heddles 19 can be displaced along the harness frame and parallel to the warp beam axis. The arrangement of the heddles 19 on the heddle support rails 18 and the position of the eyes of the heddles 19 are clearly shown in FIG. 6.

Correspondingly, the drop wire rails 21 are provided parallel to the harness frames and permit displacing the drop wires 20 thereon. As shown by FIG. 5, the heddles 19 and the drop wires 20 are tightly arrayed in packs on one of the sides of the support rails 18 and 21, respectively. Before being packed, the uppermost heddles 19 or drop wires 20 are each lifted and moved into the draw-in position wherein the draw-in needles 11 can be pulled through the eyes of the heddles or drop wires. The positioned heddles 19 or drop wires 20, together with the passed needles 11, are then located precisely in front of the separated warp threads 10*a*. When the needles 11 are advanced as far as into the end position shown in dashed lines in FIG. 6, they then there seize the separated warp thread and, during the retraction of the needles, pull it through the eyes of the drop wire 20 and heddle 19. In the process of the invention, the thread end is pulled out of the clamping rail 16*a* and, as shown in FIG. 5, is looped out on the left of the harness frame 17 and stretched. The warp thread ends which are pulled through are denoted by 10*b* in FIG. 5. Finally, it also should be noted that the warp threads remain clamped in the clamping rail 16*b* during the draw-in process.

After the separated warp threads shown in the position of the heddles 19 or drop wires 20 in the center of FIG. 5 have been drawn in, the heddles and drop wires will be moved, in a manner not further described, toward the other end of the harnesses 17.

FIG. 5 shows that one heddle 19 and one drop wire 20 is associated with each warp thread end 10*b* which was pulled through. After the heddles and the drop wires, together with their pulled-through warp threads, have been moved into their end position, new heddles 19 and drop wires 20 are separated from the pack and moved into position. Simultaneously, the required number of warp threads 10*a* are separated and readied for drawing-in.

The entire apparatus is so designed that, in known manner, the devices for the guidance and the path of the draw-in needles 11, as well as the mechanism for singling out the warp threads with the tensioning shaft 1 and sleeve 6, on the one hand, remain mutually fixed in place while, on the other hand, they are displaceable relative to the warp beam K and the pack of the harnesses 17 and also the drop-wire rails 21. The relative displacement takes place according to the continuing separation of further warp threads from the thread curtain at the warp beam. A relative displacement between these components is known. It is assumed in this embodiment that the mechanism for singling out the warp threads and the device for pulling the warp threads through remains fixed in place and that the warp beam as well as the harnesses and drop wire rails are displaceable in the axial direction of the warp beam.

It will be obvious to those skilled in the art that many modifications may be made within the scope of the present invention without departing from the spirit thereof, and the invention includes all such modifications.

What we claim is:

1. In a device for individually separating and readying warp threads (10*a*) wound on a warp beam and presented in the form of a curtain of threads (10*a*) for a draw-in procedure of warp threads into apertures of heddles and drop wires by means of a warp thread draw-in apparatus equipped with mutually parallel draw-in needles (11), the improvement comprising a rotatable tensioning shaft (1) mounted behind the curtain of threads (10) transversely to the direction of the threads, said tensioning shaft gradually merging at its end in a transition (2) into a cylindrical end part (3) of larger diameter, drive means (14) operatively connected to said tensioning shaft for rotating said tensioning shaft, a cylindrical sleeve (6) having a larger diameter than said cylindrical end part of said tensioning shaft, said cylindrical sleeve further comprising a screw-like guidance groove (8) including a guide beak (7) leading into said guidance groove (8) for guiding an individual warp thread into said screw-like guidance groove, means (26) coaxially and rotatably mounting said cylindrical sleeve (6) on said tensioning shaft (1), said mounting means (26) enabling said cylindrical sleeve to rotate with said tensioning shaft and to permit rotation of said tensioning shaft independently of said cylindrical sleeve (6) when the latter is stopped, and control means operatively arranged for controlling the rotation of said cylindrical sleeve (6) with said tensioning shaft and for stopping said cylindrical sleeve relative to said tensioning shaft to thereby determine the number of full revolutions of said cylindrical sleeve for guiding a respective number of warp threads into said screw-like guidance groove.

2. The device of claim 1, wherein the number of turns in the guidance groove (8) of said cylindrical sleeve (6) corresponds to the number of the draw-in needles (11) simultaneously drawing the individualized warp threads (10*a*) into the apertures of said heddles and drop wires for pulling through the particular associated warp threads.

3. The device of claim 1, wherein the pitch of the guidance groove (8) in the cylindrical sleeve (6) corresponds to the spacing between said mutually parallel draw-in needles (11).

4. The device of claim 1, wherein said control means are responsive to control signals for permitting single revolutions of said cylindrical sleeve (6), whereby rotation of said cylindrical sleeve is controlled in a step-wise manner.

5. The device of claim 4, wherein said step-wise controlled drive of said cylindrical sleeve (6) follows a transfer of readied warp threads (10*a*) to the needles (11).

6. The device of claim 5, wherein a number of directly consecutive single revolutions of said cylindrical sleeve corresponds to the number of the warp threads (10*a*) which must be drawn in simultaneously by the draw-in needles.

7. The device of claim 1, wherein said drive means (14) for said tensioning shaft (1) is a continuous drive.

8. The device of claim 1, wherein the tensioning shaft (1) together with its end part (3) defines a slight slant (angle b) with respect to a plane (10*b*) of a curtain of warp threads (10) in such a manner that at least said end part (3) increasingly deflects over its length the warp threads (10) of a curtain of warp threads from their previous rectilinear path.

9. The device of claim 8, wherein said tensioning shaft (1) is rotatably mounted at a slight slope (angle a) rising toward the end part (3) of said tensioning shaft.

10. The device of claim 1, wherein said guide beak (7) forms a knife edge at the beginning of the guidance groove (8) for always separating the foremost thread (10) of a curtain of warp threads.

11. The device of claim 1, wherein said tensioning shaft (1) has a shortened length, and means for supporting said shortened tensioning shaft in a cantilever manner at one end of said tensioning shaft.

* * * * *